US009192008B2

(12) United States Patent
Eckel et al.

(10) Patent No.: US 9,192,008 B2
(45) Date of Patent: Nov. 17, 2015

(54) REDUCED-SIZE MODULAR LED WASHLIGHT COMPONENT

(71) Applicant: B/E Aerospace, Inc., Wellington, FL (US)

(72) Inventors: David P. Eckel, Fort Salonga, NY (US); Eric Johannessen, Bohemia, NY (US); Erick Palomo, East Moriches, NY (US); Jonathan Brosnan, Hicksville, NY (US)

(73) Assignee: B/E AEROSPACE, INC., Wellington, FL (US)

( * ) Notice: Subject to any disclaimer, the term of this patent is extended or adjusted under 35 U.S.C. 154(b) by 111 days.

(21) Appl. No.: 13/842,725

(22) Filed: Mar. 15, 2013

(65) Prior Publication Data

US 2013/0249404 A1 Sep. 26, 2013

Related U.S. Application Data

(60) Provisional application No. 61/615,495, filed on Mar. 26, 2012, provisional application No. 61/726,010, filed on Nov. 13, 2012.

(51) Int. Cl.

| | |
|---|---|
| ***F21V 21/00*** | (2006.01) |
| ***H05B 33/08*** | (2006.01) |
| ***H05B 37/02*** | (2006.01) |

(52) U.S. Cl.

CPC ..... *H05B 33/0842* (2013.01); *H05B 33/086* (2013.01); *H05B 37/0254* (2013.01)

(58) Field of Classification Search

USPC ..... 362/217.01, 217.1, 249.02, 470, 471, 362/487, 488, 546, 362

See application file for complete search history.

(56) References Cited

U.S. PATENT DOCUMENTS

| | | | |
|---|---|---|---|
| 4,729,742 | A | 3/1988 | Onishi et al. |
| 5,003,432 | A | 3/1991 | Mandy |
| 5,490,048 | A | 2/1996 | Brassier et al. |
| 5,677,603 | A | 10/1997 | Speirs et al. |
| 5,825,135 | A | 10/1998 | Chang |
| 6,016,038 | A | 1/2000 | Mueller et al. |

(Continued)

FOREIGN PATENT DOCUMENTS

| | | | |
|---|---|---|---|
| EP | 1901587 | A2 | 3/2008 |
| JP | 20030524284 | A | 8/2003 |

(Continued)

OTHER PUBLICATIONS

U.S. Appl. No. 13/035,329, filed Feb. 25, 2011, Gambeski et al.

(Continued)

*Primary Examiner* — Thuy Vinh Tran

(74) *Attorney, Agent, or Firm* — Drinker Biddle & Reath LLP

(57) ABSTRACT

A light-emitting diode (LED) light module is provided, comprising: a single-piece printed circuit board (PCB) comprising the following integrated on the PCB: a plurality of LEDs in each of a plurality of LED groups; a power supply converter; a controller module comprising a processor, memory, operational program stored in the memory and executable by the processor; input/output (I/O) circuitry, and an LED driver that drives the LEDs; the module further comprising: a single metallic housing that contains the PCB; a heat sink that conducts heat from components on the PCB to the housing; and a lens for diffusing or directing lights from the LEDs.

14 Claims, 14 Drawing Sheets

(56) References Cited

U.S. PATENT DOCUMENTS

| | | | | |
|---|---|---|---|---|
| 6,211,626 | B1 | 4/2001 | Lys et al. | |
| 6,220,721 | B1 | 4/2001 | Chan et al. | |
| 6,366,469 | B1 * | 4/2002 | Odenberg et al. | 361/790 |
| 6,815,842 | B2 | 11/2004 | Fehd et al. | |
| 7,114,827 | B2 | 10/2006 | Halter | |
| 7,161,556 | B2 | 1/2007 | Morgan et al. | |
| 7,173,383 | B2 | 2/2007 | Vornsand et al. | |
| 7,198,387 | B1 | 4/2007 | Gloisten et al. | |
| 7,266,315 | B2 | 9/2007 | Sato | |
| 7,494,255 | B2 | 2/2009 | Bryan et al. | |
| 7,658,506 | B2 | 2/2010 | Dowling | |
| 7,717,593 | B2 | 5/2010 | Clark | |
| 7,717,594 | B2 | 5/2010 | Clark | |
| 8,111,968 | B2 * | 2/2012 | Chakmakjian et al. | 385/146 |
| 8,299,716 | B2 * | 10/2012 | Melzner et al. | 315/113 |
| 8,491,151 | B2 * | 7/2013 | Spartano | 362/205 |
| 2002/0172052 | A1 | 11/2002 | Perlo et al. | |
| 2003/0208764 | A1 | 11/2003 | Galipeau et al. | |
| 2004/0183480 | A1 | 9/2004 | Halter | |
| 2004/0240211 | A1 | 12/2004 | Rodgers et al. | |
| 2005/0174309 | A1 | 8/2005 | Bouwens et al. | |
| 2005/0202785 | A1 | 9/2005 | Meyer | |
| 2005/0275912 | A1 | 12/2005 | Chen et al. | |
| 2006/0146553 | A1 * | 7/2006 | Zeng et al. | 362/488 |
| 2006/0187081 | A1 | 8/2006 | Gloisten et al. | |
| 2007/0034775 | A1 | 2/2007 | Cheng et al. | |
| 2007/0097675 | A1 | 5/2007 | Koren et al. | |
| 2007/0103646 | A1 | 5/2007 | Young | |
| 2007/0139941 | A1 | 6/2007 | Bryan et al. | |
| 2007/0236423 | A1 | 10/2007 | Chiou et al. | |
| 2007/0274084 | A1 | 11/2007 | Kan et al. | |
| 2007/0291483 | A1 | 12/2007 | Lys | |
| 2008/0089071 | A1 | 4/2008 | Wang et al. | |
| 2008/0136334 | A1 | 6/2008 | Robinson et al. | |
| 2008/0197788 | A1 | 8/2008 | Conover et al. | |
| 2008/0215279 | A1 | 9/2008 | Salsbury et al. | |
| 2008/0238339 | A1 | 10/2008 | Deurenberg et al. | |
| 2008/0253122 | A1 | 10/2008 | Hancock et al. | |
| 2008/0266887 | A1 | 10/2008 | Wentland et al. | |
| 2009/0001251 | A1 | 1/2009 | Ng et al. | |
| 2009/0059610 | A1 | 3/2009 | Marshall et al. | |
| 2009/0140630 | A1 | 6/2009 | Kijima et al. | |
| 2009/0237943 | A1 | 9/2009 | Eckel et al. | |
| 2009/0251898 | A1 | 10/2009 | Kinnune et al. | |
| 2010/0007588 | A1 | 1/2010 | Zygmunt et al. | |
| 2012/0019164 | A1 | 1/2012 | Gambeski et al. | |
| 2012/0307487 | A1 * | 12/2012 | Eckel | 362/231 |
| 2013/0082616 | A1 * | 4/2013 | Bradford et al. | 315/193 |

FOREIGN PATENT DOCUMENTS

| | | | |
|---|---|---|---|
| JP | 2004-006253 | A | 1/2004 |
| JP | 2004-158370 | A | 6/2004 |
| JP | 2005-517278 | A | 6/2005 |
| JP | 2007-109584 | A | 4/2007 |
| JP | 2007-249647 | A | 9/2007 |
| JP | 2008-109514 | A | 5/2008 |
| JP | 2008-135224 | A | 6/2008 |
| WO | 03/067934 | A2 | 8/2003 |
| WO | 2008-047335 | A1 | 4/2008 |
| WO | 2009-035493 | A1 | 5/2009 |

OTHER PUBLICATIONS

U.S. Appl. No. 13/034,983, filed Feb. 25, 2011, Eckel et al.
U.S. Appl. No. 13/035,626, filed Feb. 25, 2011, Greenfield.
Supplemental Search Report issued in related application EP09816872.7, dated Aug. 22, 2012, 6 pages.
Office Action issued in related application JP2011-528100 with English translation, dated Jan. 10, 2013, 7 pages.
International Search Report and Written Opinion issued in related application PCT/US2013/0033756, Jun. 18, 2013, 13 pages.

* cited by examiner

REDUCED-SIZE MODULAR LED WASHLIGHT COMPONENT

CROSS REFERENCE TO RELATED APPLICATIONS

The present application claims the benefit of U.S. Provisional Application No. 61/615,495, filed Mar. 26, 2012, entitled, "Reduced-Size Modular LED Washlight Component", and U.S. Provisional Application No. 61/726,010, filed Nov. 13, 2012, entitled, "Modular LED Washlight Component", both herein incorporated by reference.

BACKGROUND

The use of LEDs in the production of wash lighting units provide the capabilities to create a wide range of colors that can be controlled by a centralized control system. However, if a wide range of colors are not needed, cost can be reduced based on providing modules that have a more limited range of colors.

A small and efficient modular light-emitting diode (LED) washlight component that is usable in, e.g., a vehicle, such as an aircraft is provided comprising a direct DC power input. This design relates to designs disclosed in the following U.S. patent applications, all of which are incorporated herein by reference:

| Application SN | Filing Date | Title |
|---|---|---|
| 61/099,713 | 24 SEP. 2008 | AN AIRCRAFT LED WASHLIGHT SYSTEM AND METHOD FOR CONTROLLING SAME |
| 61/105,506 | 15 OCT. 2008 | AN AIRCRAFT LED WASHLIGHT SYSTEM AND METHOD FOR CONTROLLING SAME |
| 12/566,146 | 24 SEP. 2009 | AN AIRCRAFT LED WASHLIGHT SYSTEM AND METHOD FOR CONTROLLING SAME |
| 61/308,171 | 25 FEB. 2010 | LIGHTING SYSTEM FOR VEHICLE CABIN |
| 61/320,545 | 25 FEB. 2010 | LIGHTING SYSTEM FOR VEHICLE CABIN |
| 61/345,378 | 17 MAY 2010 | LIGHTING SYSTEM FOR VEHICLE CABIN |
| 13/034,983 | 25 FEB. 2011 | AN AIRCRAFT LED WASHLIGHT SYSTEM AND METHOD FOR CONTROLLING SAME |
| 13/035,626 | 25 FEB. 2011 | LED LIGHTING ELEMENT |
| 13/035,329 | 25 FEB. 2011 | CALIBRATION METHOD FOR LED LIGHTING SYSTEMS |

SUMMARY

The following is a table of acronyms which may be used in the discussion below.

TABLE 1

| | |
|---|---|
| AC | Alternate Current |
| ANSI/IEEE | American National Standards Institute/Institute of Electrical and Electronics Engineers |
| B/E | B/E Aerospace |
| CMS | Cabin Management System |
| CPU | Central Processing Unit |
| CRC | Cyclic Redundancy Code |
| CTS | Component Technical Specification |
| DC | Direct Current |
| DHCP | Dynamic Host Configuration Protocol |
| FAA | Federal Aviation Administration |
| ILDC | Integrated LED and Digital Controller |
| IP | Internet Protocol |
| ISO | International Standards Organization |

TABLE 1-continued

| | |
|---|---|
| LED | Light Emitting Diode |
| LRU | Line Replaceable Unit |
| MRB | Material Review Board |
| MRP | Material Requirements Planning |
| PAIL | Program Action Item List |
| PC | Personal Computer |
| PCB | Printed Circuit Board |
| PHY | Physical Layer Protocol |
| PM | Program Manager |
| PMA | Parts Manufacturer Approval |
| PWM | Pulse Width Modulation |
| RAM | Random Access Memory |
| RBW | Red Blue White |
| RGW | Red Green White |
| RGB | Red Green Blue |
| RGB + W, RGBW | Red Green Blue plus White |
| SRC | Supplier Report Card |
| STC | Supplemental Type Certificate |
| STP | Shielded Twisted Pair |
| WWA | White White Amber |
| WWR | White White Red |
| WWW | White White White |

As described in more detail below, a light-emitting diode (LED) light module is provided, comprising: a single-piece printed circuit board (PCB) comprising the following integrated on the PCB: a plurality of LEDs in each of a plurality of LED groups; a power supply converter; a controller module comprising a processor, memory, operational program stored in the memory and executable by the processor; input/output (I/O) circuitry, and an LED driver that drives the LEDs; the module further comprising: a single metallic housing that contains the PCB; a heat sink that conducts heat from components on the PCB to the housing; and a lens for diffusing or directing lights from the LEDs.

DESCRIPTION OF THE DRAWINGS

The invention is explained below according to various embodiments illustrated in the drawing figures and discussed in the Detailed Description section.

DETAILED DESCRIPTION

Figure 1:
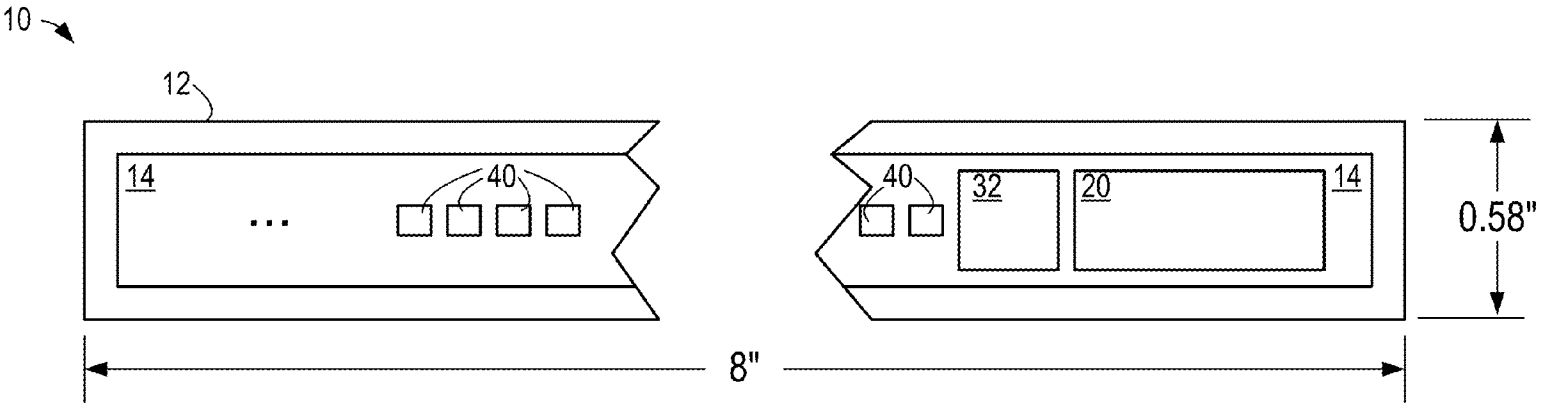
FIG. 1 is a pictorial top view block diagram illustrating an exemplary LED light module with exemplary dimensions.

Referring to FIG. 1, the component module 10 (wash light) comprises a housing 12 that may be made of a metallic extrusion. Embodiments of the invention include a set of different length modules 10 having integer multipliers of some underlying measurement value. For example, one version of the module is designed to have a length that is 8" (an underlying measurement value of 4" with a multiplier of 2), although a related series of modules are envisioned having lengths of 12", 16", etc., accordingly (multipliers of 3, 4, etc., i.e., in steps of 4"), so that modules can be purchased to fill a wide variety of spaces on a number of different aircraft designs. More generally, the lengths of modules can be expressed as m×n", where n=4" and m is a set of integer values from 2 to 24.

The component module comprises one or more printed circuit boards (PCB) 14 that includes a power supply 20, module controller 32, and LEDs 40. In an embodiment, the LEDs 40 are arranged in a linear array across the PCB(s), and, e.g., in a red, green, blue (RGB)+white configuration. The power supply 20 and module controller 32 can be integrated together. The power supply 20 can be designed to run based on 28 VDC, but should be able to operate over a range, e.g., from 18 VDC to 30.3 VDC. Since the input to the module is DC, there need only be a single power supply, a single DC switch, and it is not necessary to have an isolated design—the power supply can be referenced to the aircraft chassis. The system is designed to consume approximately 6 Watts per foot. Appropriate filtering 35 (FIG. 3) and shielding is provided to cancel radiated energy, conducted EMI, spike surges, etc.

The module 10 may comprise a thermal management system coupled with a thermal heat sinking design. The module 10 may comprise a temperature sensor that monitors the internal temperature of the module 10 and regulates LED PWM duty cycles to maintain an optimal operating temperature and calibrated light output within LRU temperature specifications.

Figure 2:
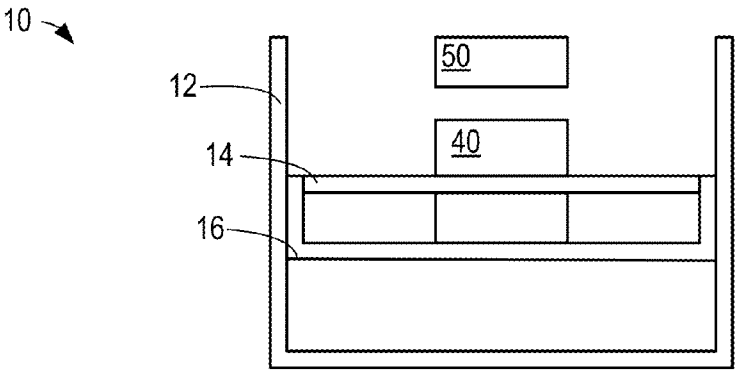
FIG. 2 is a pictorial end view block diagram illustrating the embodiment shown in FIG. 1.

FIG. 2 illustrates an exemplary U-shaped housing 12 that could be used in the design, which may be produced as an extrusion. A thermal pad 16 may be provided into which the PCB 14 can be pressed in order to help distribute heat and conduct it to the housing 12 so that it can be removed from the module 10. In any case, the thermal aspects of the module 10 may be determined by measurement and according to some calibration sequence, such as described in the patent applications incorporated by reference.

In addition, this module may have a lens 50 that can be used to direct or diffuse the light. In one embodiment, the lens is made in a manner, such as a using micro-structured features, that direct the light in a single direction.

Figure 3:
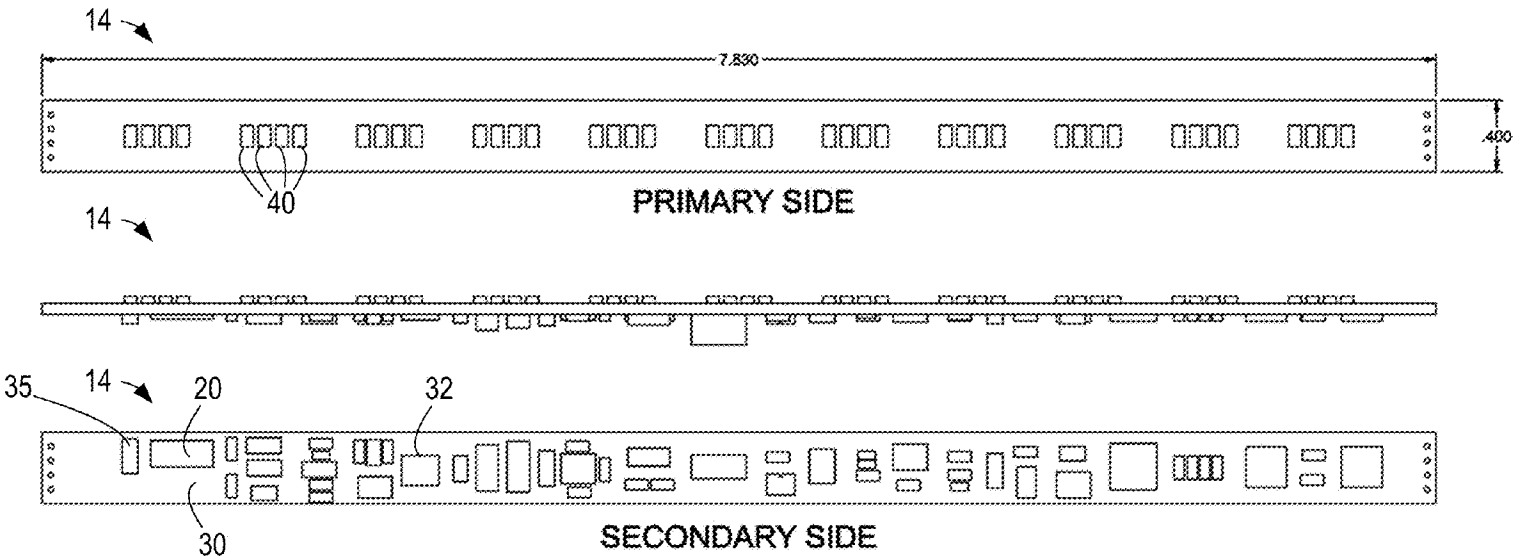
FIG. 3 comprises pictorial top, side, and bottom views of an exemplary 8" PCB for the LED light module.
Figure 4:
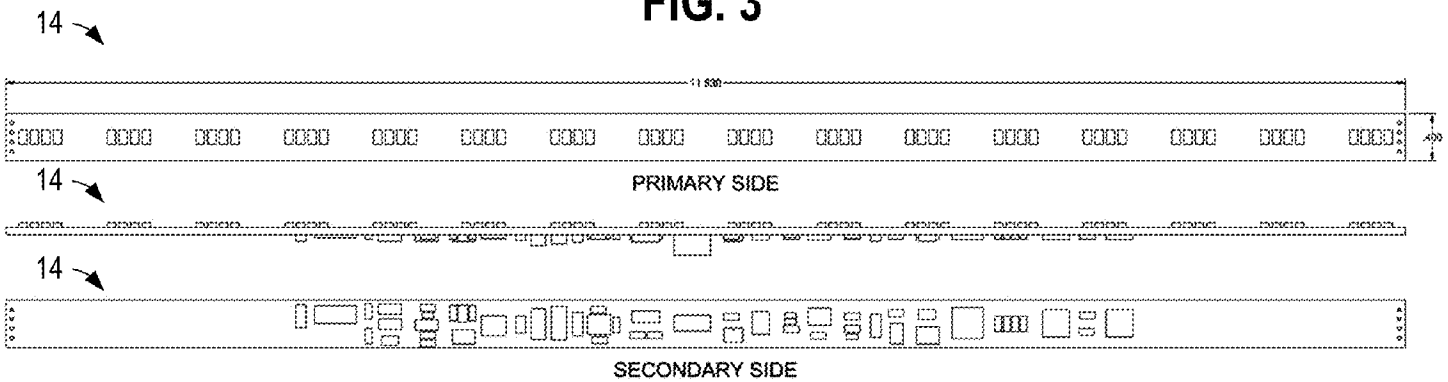
FIG. 4 comprises pictorial top, side, and bottom views of an exemplary 12" PCB for the LED light module.

FIGS. 3 and 4 provide exemplary PCB 14 component layouts for the LED modules 10. FIG. 3 is an example used for the 8" module, having overall dimensions of 7.83"×0.4". FIG. 4 is an example used for the 12" module, having overall dimensions of 11.83"×0.4".

The lighting LRUs 10 may utilize a building block architecture approach where like components are utilized across cabin applications to minimize part count and maintain functionality within the system. The integrated LED, power supply and control (ILDC) board 30 may be mounted within a single aluminum extrusion. This architecture is capable of being built upon to utilize multiple ILDC PCBs 40 within a single housing 12, passing 28VDC through jumper boards 15 (FIG. 8) and thus supporting multiple length lighting assemblies.

Figure 5A:
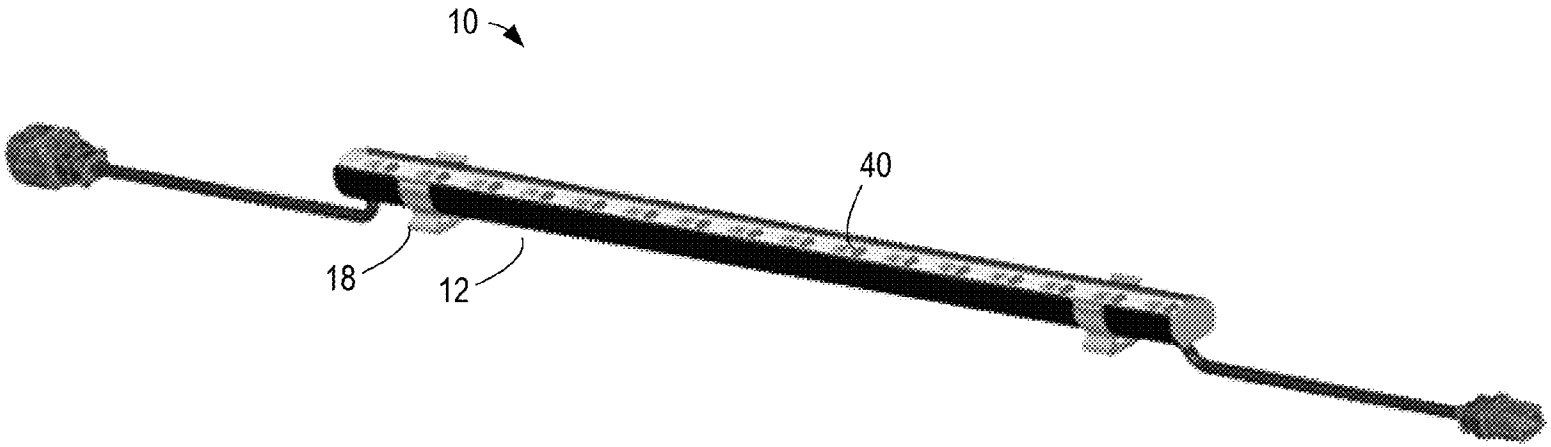
FIGS. 5A and 5B are respectively perspective and front views of an LED module in assembled form, showing clips and connectors.
Figure 5B:
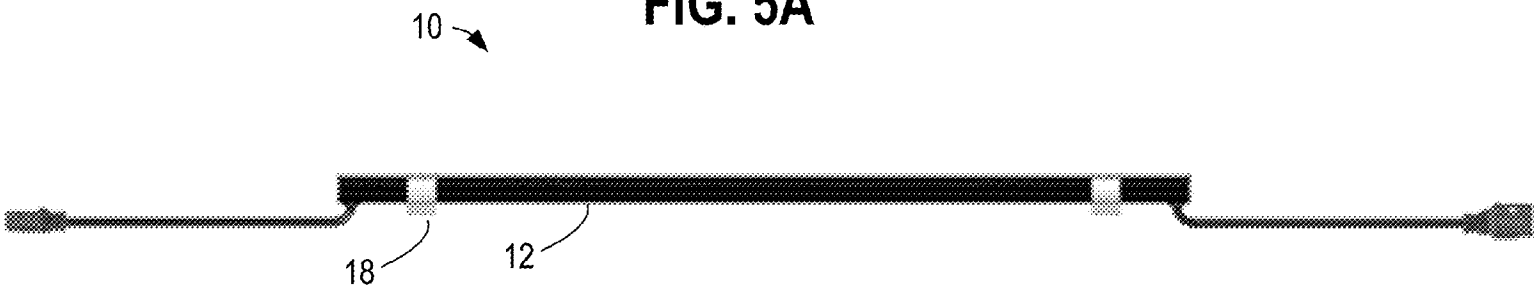
Figure 6:
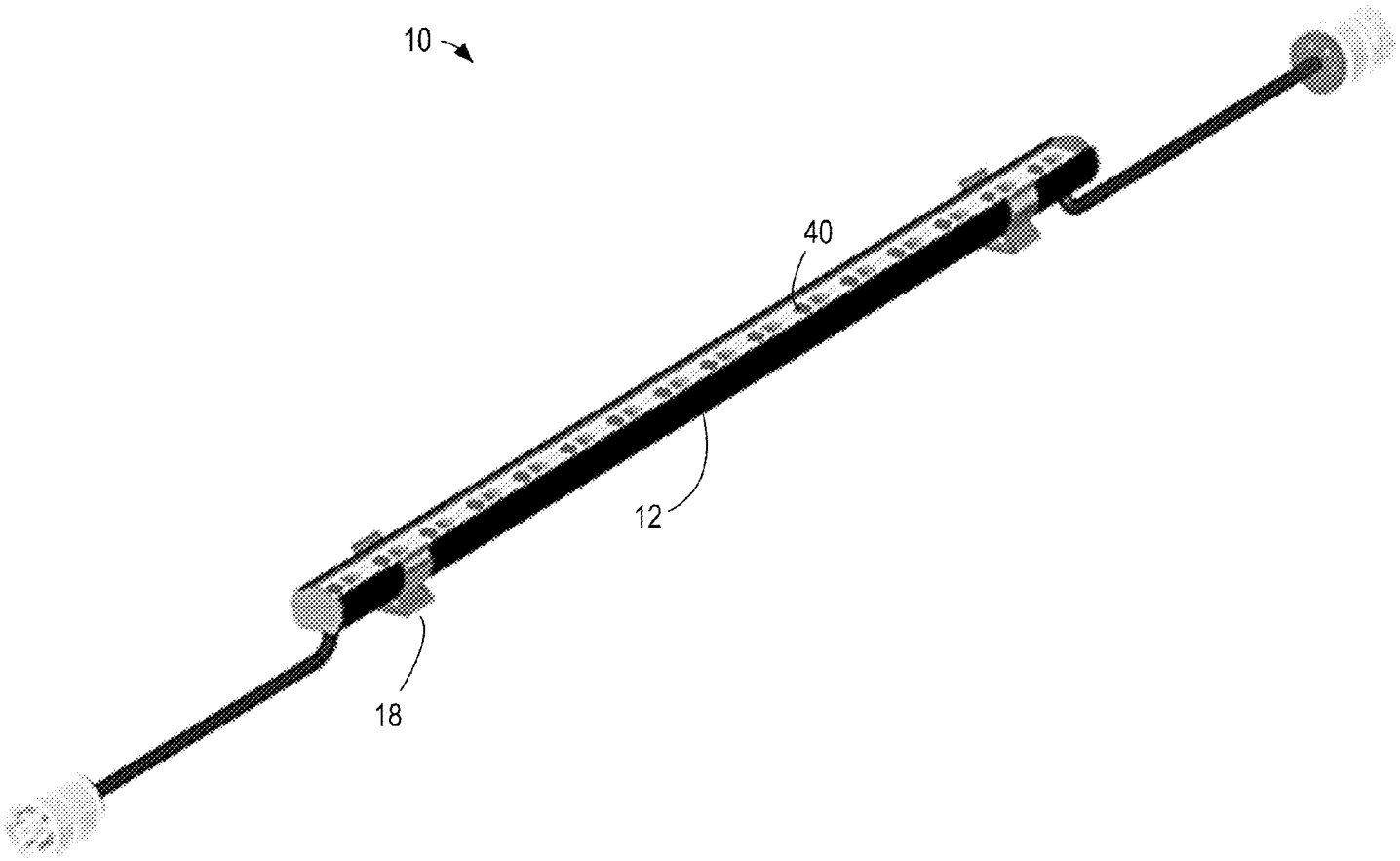
FIG. 6 is a perspective view of an LED module in assembled form, showing different connectors from those in FIGS. 5A, 5B.

This architecture is designed to adapt various, custom optics to specific airplane applications. This allows optimization of mixing and beam patterns as well as lumen output. Conceptually, application specific LRUs and lighting assemblies 10 are able to utilize a host of extruded lens types 50 from collimator to asymmetric in order to meet system photometric requirements. Wash light LRU's 10 may be equipped with end-caps/connectors optimized for this application and can include harnessing/connector options as required by a particular application. FIGS. 5A, 5B, and 6 provide exemplary designs with different connector configurations.

Figure 7:
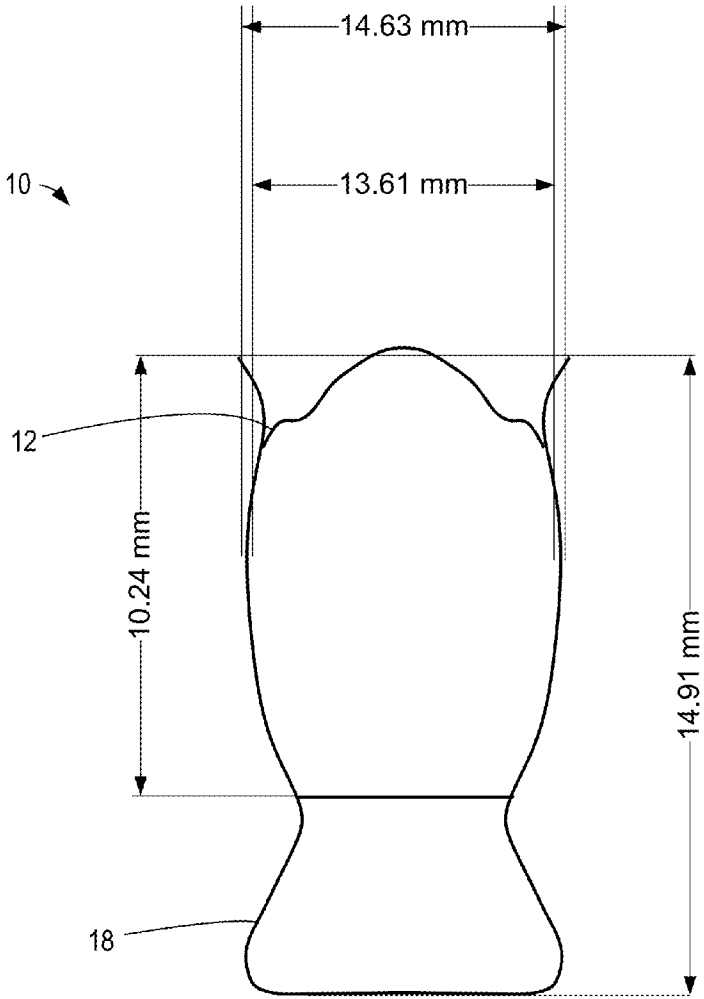
FIG. 7 is a schematic end cross-section showing the LED module within a clip.

FIG. 7 illustrates exemplary dimensions of a module 10 with a mounting clip 18. Universal spring "snap" clips 18 may be used for mounting and can be adapted to custom brackets for various applications within the aircraft. Bracket location, mounting elements and angles can be determined prior to installation.

Figure 8:
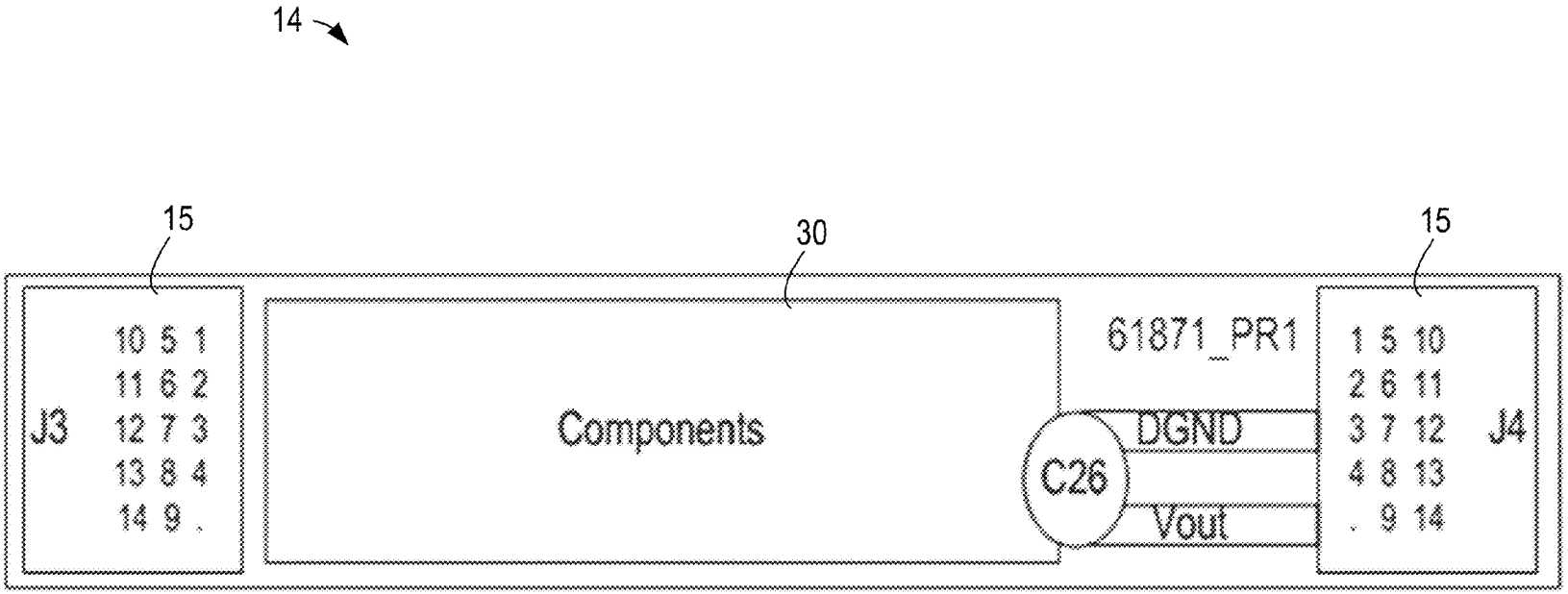
FIG. 8 is a pictorial view of a PCB with jumpers at the ends.

FIG. 8 illustrates an exemplary PCB 14 design using FR-4 per IPC4101/24 or IPC4101/124 with a glass transition temperature of 170° C. minimum certified to UL 94 V0. The ILDC 30 and jumper portion 15 are also shown.

Figure 9:
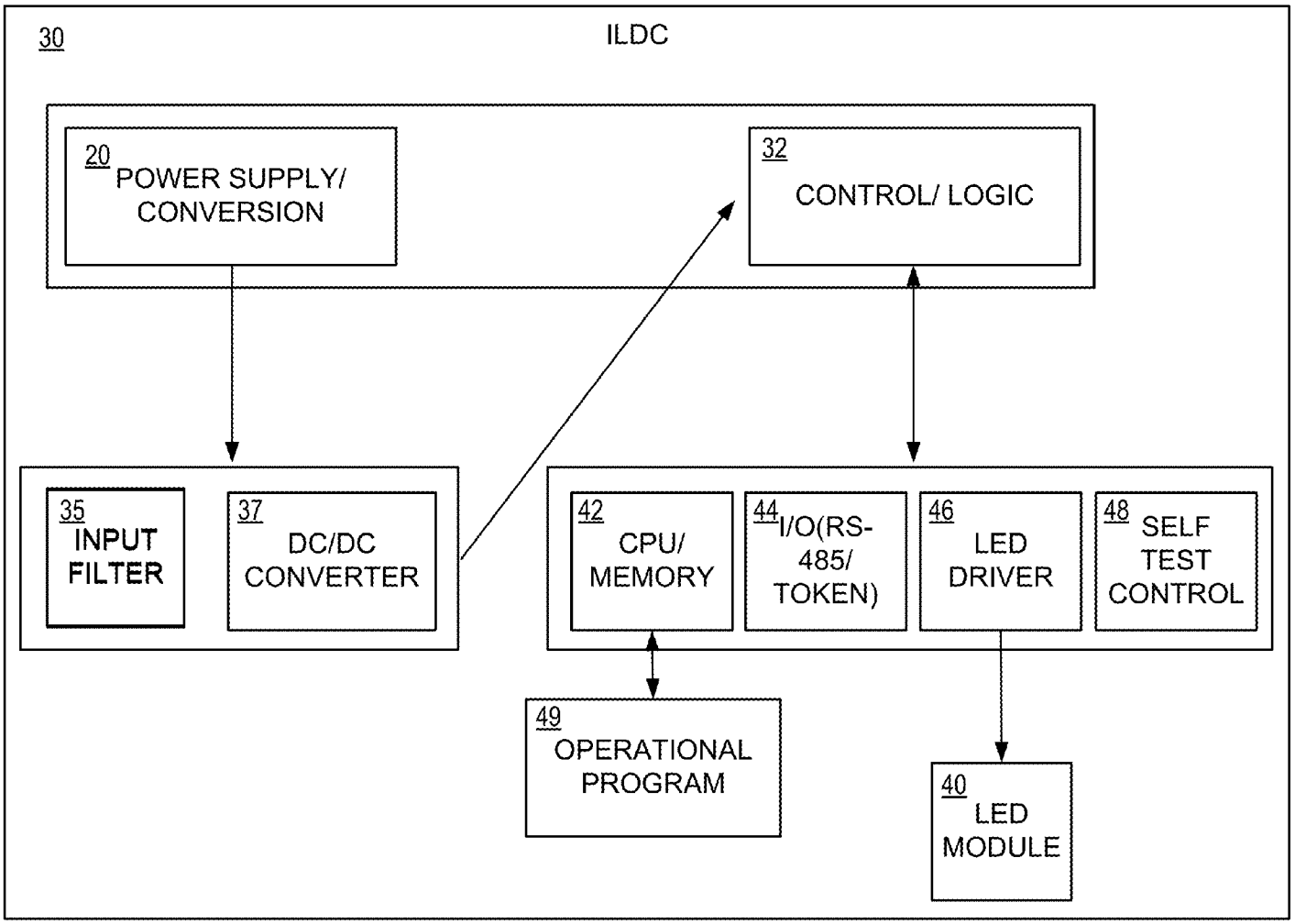
FIG. 9 is a block diagram of the integrated LED and digital control (ILDC) board.

The ILDC 30 electrical hardware may comprise a power supply section 20, logic and control section 32 and LED modules 40. The power supply section 20, control and logic section 32, may comprise two main building blocks and seven sub blocks. The two main blocks, as illustrated in FIG. 9, are the power supply/conversion 20 and control/logic 32. The power supply/conversion section 20 receives the nominal 28VDC aircraft power and produces the low DC voltage required for the digital control and logic section 32. The control/logic section 32 includes the microcontroller 42, memory 42, LED driver and controls 46, communication I/O 44 and safety features 48. The following is an overview of the building blocks and their function.

The power conversion/supply section 20 incorporates DC to DC conversion 37 and filtering 35 that fits in a streamlined form factor and housing.

The DC to DC power supply 37 design utilizes a buck converter topology, capable of maintaining LRU operation within the 18 to 32 VDC range. The purpose of the power supply is to provide the output voltages for driving and controlling LED's, logic/memory 42 and I/O 44 for communications and addressing.

There are four main logic blocks required in the ILDC 30. The CPU (microcontroller & memory) 42, I/O (token and RS-485) 44, LED control/driver 46, and Self test/control are the four blocks and are shown in FIG. 9.

The CPU block 42 may comprise a precision oscillator, a low dropout regulator and a microcontroller that has the necessary memory/code space for a boot sector, operational firmware, configuration data (such as address and zone), and calibration data unique to a particular Lighting LRU, such as color points, LRU type and board length. The microcontroller is essentially the brain used to run all the functions of the IPSC board and other I/O functions.

One of the primary tasks of the microcontroller (MCU) 42 is to control the LED's. Their drive current, duty cycle and color mixing algorithms are all processed in real time within the MCU. The secondary function is to interface with the cabin management system (CMS) via RS-485. RS485 communication is processed and scene requests are decoded within the MCU via an RS-485 transceiver. This scene information may be used to extract the correct PWM values from memory, which are processed via algorithms that calculate LED pulse width based on temperature compensation, transition interval, calibration constants, and aging compensation.

The I/O "Input/Output" block 44 illustrates how the unit may connect to the outside world. RS-485 is an exemplary communication protocol and physical layer interface to the Lighting LRU 10. These commands are received from the CMS. The RS-485 transceiver may have numerous protection devices such as ESD protection and failsafe "float when damaged" operation. Each wash light LRU 10 has its own logical address which is configured by a Token In/Out scheme. The token may be an isolated pull down that is used during system configuration. This advantage gives each wash LRU 10 its address based on position within the aircraft rather than serial number.

The LED driver 46 chosen has high pulse width resolution, low temperature drift and stable current drive vs. voltage. Preferably, an LED driver 46 that is fully configurable in software is used. This enables the use of a single ILDC part number which can support multiple board lengths and configurations.

The last block in the logic section of the ILDC is the self-test and control 48. In this block 48, the power supply voltage and temperature are monitored. The temperature data may be used to either control LED duty cycle for flux compensation or shutdown the unit in a safe manner if there is a failure causing overheating. The voltage data lets the unit disable the LEDs 40 during a temporary power drop. The advantage of this is that the CPU block has enough power to store current scene selection data and recover rapidly when the power returns. This allows lighting control units time to reboot and reset the scene or transition to a new scene if needed.

Figure 10:
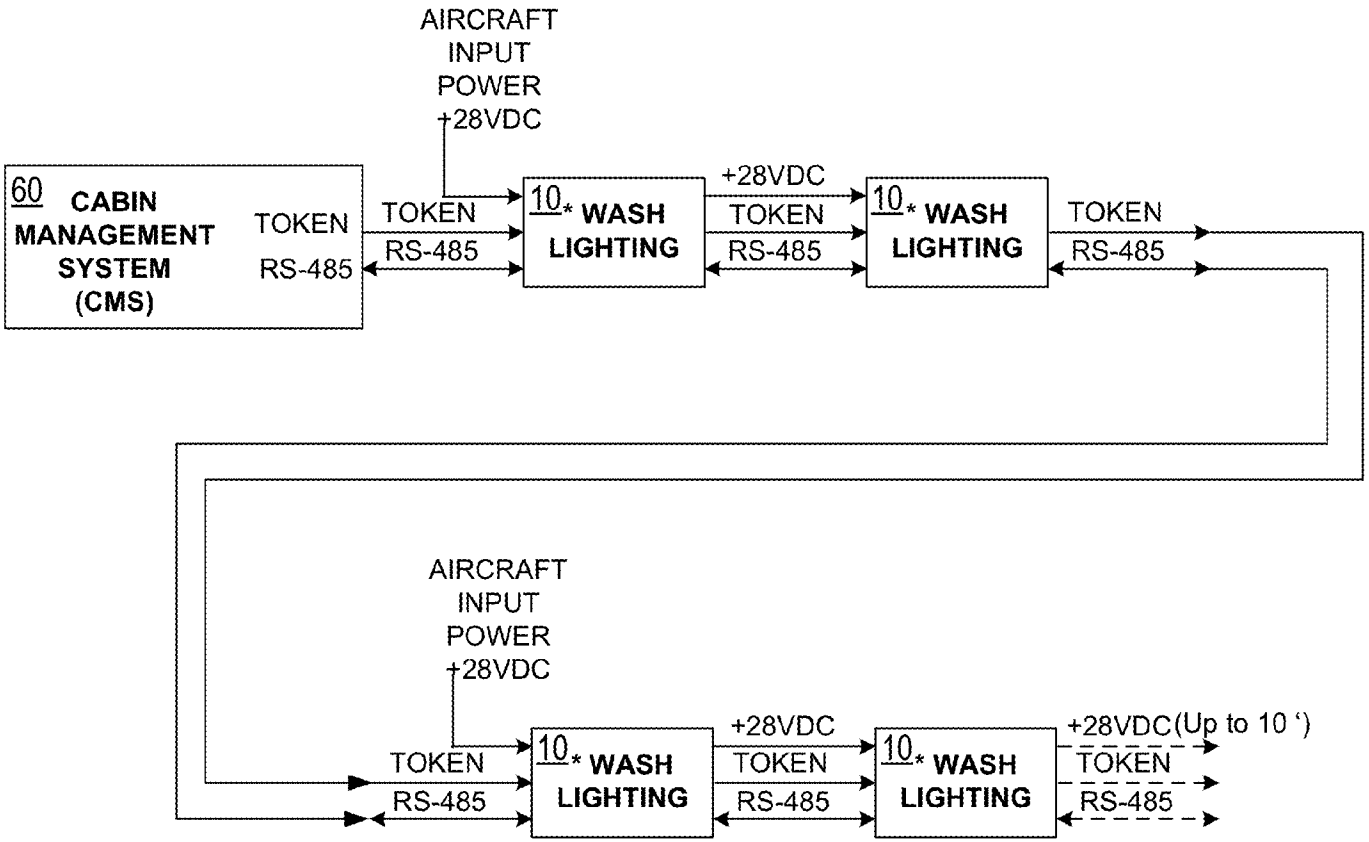
FIG. 10 is a block diagram illustrating connecting together a plurality of LED modules.

FIG. 10 provides an exemplary illustration of a wash light port concept that interconnects the modules 10. The LED wash light technology incorporating an RGB+W wash lighting architecture is discussed in the following. Control and addressing of the cabin lighting system may be achieved using the integrated RS-485 capability of the wash lights as commanded from the CMS 60.

An RGB+W wash light 10 may conform to the following specifications and use the following exemplary components:

Summary: Standard 28VDC Calibrated RGB+W Wash Lighting System with Integrated Control
LED: Nichia 095A/B or newer
Lens: Flat, clear or translucent resin
LED Clustering: 13-15 per foot
Power Supply: Integrated DC Power Supply, operational range of 18-32 volts
Power: 4-6 watts per foot
Control: RS-485 with optional Tokening for Addressing Applications
Cross-section Size: 14.9 mm (0.59")×14.6 mm (0.56") including mounting clip
Alternate Size: 0.55"×0.71", 0.82" X 0.68"
Housing: 'U' Extrusion
Mounting: Snap Clip
Architecture: Integrated LED and Digital Controller (ILDC)
Double Sided PCB
Dual harness configuration, exiting side or back of housing to enable side by side installation
Weight: 3.9 Oz. (110 g) Per foot; alternately 2.6 Oz. per foot
Lengths: 8, 12, 16, 20, 24, 28 inch lighting assemblies (additional 4" segment lengths possible)
Harness Type: DC Input with RS-485 or DC Input with RS-485+Token
Connector: Deutsch 369 series or equivalent
Calibration Methodology:
4 Step ME, 32 Color Point, expandable to 64 CP
Integration Box Primary Color/Flux measurement
Temperature and Lifetime Comp Algorithms
Validation of set points Table 2 below presents the estimated power and weight for the baseline lighting system. The exact configuration and quantity of LRUs can be refined in order to accurately address weight and power.

TABLE 2

| wash light weight | wash light power (DC) Watts |
|---|---|
| 3.9 ounces (110 g) per foot (including power and control capability) | 6 W per foot |

Each wash light LRU 10 may include the necessary power supply(s), control/address circuitry, LEDs, connectors, optics/lens, mounting hardware, software/firmware, and interface wiring/connectors for each application type, requiring no additional external controller or power supply. The lights can be powered by 28VDC, optimal, with an operational range of 18 to 32 VDC.

Wash lighting LRUs 10 may be comprised of dual sided PCB-Integrated LED and digital control boards, metal extrusions, harnesses (wiring and connectors), end caps and optical elements, as described above. The wash light LED drive scheme may include control, feedback and over temperature protection. To produce the desired color gamut, intensity and consistency of light required, a red, green, blue and white LED configuration may be used for indirect wash lighting assemblies.

LEDs 40 may be arranged in linear clusters to minimize color shadows and enhance near field mixing. The boards may be thermally coupled to aluminum housings for maximum heat transfer and dissipation. Carefully managing of the thermal loading on the LEDs improves the efficiency and maximizes the lifespan. As part of the thermal management, the LEDs may be run at less than their rated capacity. This drive current de-rating promotes life spans far exceeding those projected at manufacturer rated LED power levels.

The ILDC boards 30 may be designed with LEDs on the topside and power and control components on the bottom, in an effort to reduce size and weight. The LEDs 40 may receive a constant current pulse width source to set brightness and color points, with PWM operating frequencies of equal to or greater than 250 Hz to minimize perceived flicker. There is available headroom in the PWM drive that can be utilized as required.

Each Lighting LRU 10 may be a member of a group of multi-dropped RS-485 based units on a serial bus (FIG. 10). Depending on the configuration of the CMS, multiple RS-485 ports can be used. In this topology, the CMS is a master device and the wash lighting LRUs are slaves. Lighting LRUs may be configured to only respond to messages as required and never send unsolicited messages, except during the addressing process. Broadcast and multicast messages from the CMS may be accessible to all wash lighting LRUs for scene control operation, but no responses are allowed in this situation.

The location of the CMS should be optimized with regard to the RS-485 serial buses for both wire length and bus loading. Such a scheme will help reduce wire weight while also reducing the possibility of noise on the bus. There exists an upper limit for the number of RS-485 nodes per bus, which is, e.g., 256 nodes, as each transceiver has a ⅛ unit load on the RS-485 bus. A single wash light LRU may have multiple RS-485 transceivers.

The amount of time required to transmit a scene message is largely a function of the number of zones on a line, where buses with multiple zones require a proportional increasing in messages to maintain the light LRUs.

All Lighting LRUs 10 may be dynamically addressable utilizing the RS-485 serial bus and token line, with any LRU capable of being placed in any position in the aircraft. Each RS-485 port of the CMS should be capable of controlling multiple wash lighting LRUs 10 in a column, with LRUs on each port in a daisy-chained series. To address all wash lighting LRUs on a port, the CMS initiates the addressing sequence by asserting a token out line and transmitting the starting address over RS-485 to the first connected Lighting LRU. Once the first LRU successfully addresses and responds as such to the CMS, the CMS can de-assert the token line. This same method of addressing propagates down the column, where each previous LRU then takes the role of the CMS by asserting its token out line and generating the next address message on the bus.

The RGB+W wash lighting LRUs 10 may be field loadable, with software loading capability being controlled via a software load application. Upon power up, the lighting LRUs 10 may start operation in boot mode, which may determine if the currently stored operational software is valid before commencing normal operation. Loading of operational software is preferably only be initiated over RS-485 by the software load application.

The downloadable data deliverable to the wash light LRUs 10 preferably includes the lighting database and configuration information. Lighting database entries should define all the possible scenes criteria, including color point, transition times, and intensity. The configuration information contains aircraft configuration and zone information, which identify how lights will interpret scene messages.

It is assumed that for easier aircraft configuration and maintenance that the lighting database, created using a lighting database creation tool, may be downloaded to the CMS for storage and subsequent download to the specified lighting LRUs as required.

The wash lighting LRU operational program may run on the microcontroller 42 on each ILDC board 30, regardless of how many ILDC boards may be in a particular wash light. Each wash light may be an addressable unit via tokening, as described above. The memory on the microcontroller 42 to support the software and embedded firmware may be segmented into several distinct areas: operational program, configuration data and calibration data.

The operational portion may control all aspects of the wash light LRU 10, including power up tests, communication handling, LED output, continuous tests, and any data logging. Power up tests may include determining if the unit is restarting from a commanded reset after data load, if the unit is restarting from a watchdog timer fault, RAM and Flash integrity checks, and verifying stored configuration and calibration data.

LED 40 output may be controlled using stored calibration values as a base. When the wash light LRU 10 is manufactured, it may be calibrated to attain the best possible LED pulse width modulation (PWM) values to achieve the desired color points. The calibrated values may be stored in flash memory on the microcontroller 42 to be retrieved by the operational program 49 during runtime.

The stored LED PWM calibration values may be read by the operational program 49 as required when a scene is selected. The program uses the PWM values for the selected state as a base and calculates actual PWM values depending on the current measured temperature, the accumulated "on" time of the LEDs, and the summed PWM values for each of the LEDs used for the particular state. The final, calculated PWM values may be sent to the LED drivers to update the actual output.

Communication from the CMS may be handled on the ILDC via an RS-485 transceiver to an integrated UART on the microcontroller. The UART is an interrupt driven receiver coupled with a custom driver that caches received data from the bus to be handled in a separate routine. The message handling routine processes command messages from the CMS while maintaining all state control for a received message. Once a message has been successfully parsed, necessary data may be passed to dedicated functions to perform the actions required by the command. These individual routines can determine, based on the received data, whether a response is required and will then prepare one accordingly to be returned within a specified timeframe.

Continuous tests and data logging are operations that may happen at regularly scheduled intervals. During runtime, the operational program may periodically check the current temperature to ensure it has not increased beyond acceptable limits and check the voltage level on the ILDC board to verify it has not dropped below safe operational range. Any noted limit violation will result in the program performing safety related actions, such as reducing or shutting down LED output to reduce heat. The operational program may also periodically store LED time, accruing runtime values based on whether a particular LED is on or off.

Each ILDC 30 can store in flash memory the unique identifiers that enable the CMS to control each lighting LRU 10. Configuration data may be updated in flash memory as required when the CMS commands a configuration change or data load. This may be a zone re-assignment, lighting database reload, or re-addressing.

Photometric and calibration algorithms and chambers described in the related patent applications may be used to verify that the wash light LRU 10 chromaticity and flux characteristics are met. This calibration process takes core LED measurements correlated to operating temperature and provides specific drive parameters to lighting elements resulting in repeatable light output from wash light to wash light.

In the lighting system design, each washlight can be configured to display a defined set of color points, each of which is defined as a flux value and a set of target color coordinates. For a wash light to emit light that complies with a specified color point, the color mixing, temperature and aging characteristics of the LEDs may be used to calculate the required PWM that will drive the LEDs.

Figure 11:
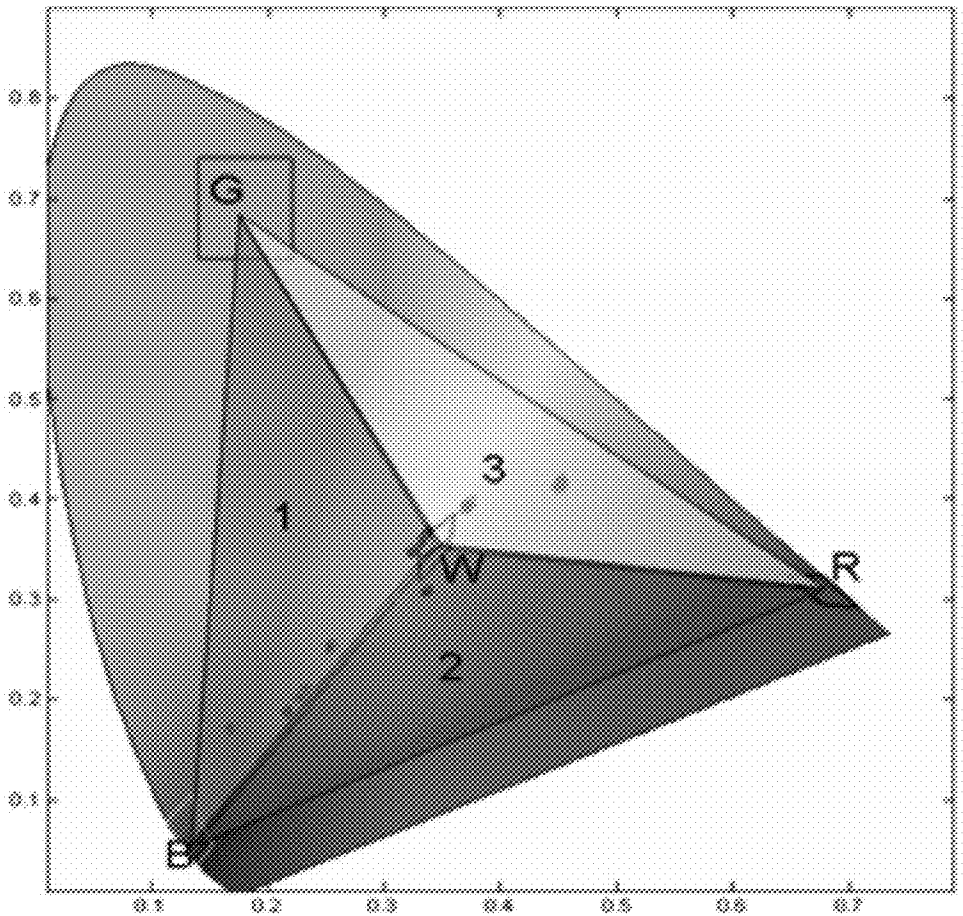
FIG. 11 is a CIE color chart illustrating different color zones.

When calibrating a wash light, each specified color point may utilize a white LED plus two of either the red, green or blue LEDs to generate the desired output. This determination will be made at calibration time based on the chromaticity coordinates of the LEDs. The two RGB colors used depend on the position of the target color coordinates on a chromaticity diagram. FIG. 11 provides an exemplary illustration for color mixing zones, where: Zone 1: GBW LEDs mixing; Zone 2: RBW LEDs mixing; and Zone 3: RGW LEDs mixing.

A wash light 10 may calculate temperature correction internally by comparing the temperature recorded during calibration to the temperature measured on the Lighting LRU during operation and deriving a correction factor based on the temperature delta from the recorded calibration temperature and compensation values determined at calibration. The temperature ranges that affect the output can be characterized as minimum, nominal and maximum operating temperature and mixing zone crossing temperature.

LED technology that features consistent light output over the rated life of the LED, custom LED binning, and calibration may be utilized to ensure a product that provides consistent light output over the life of the product.

To minimize the visual color shift during the life of the LED, the lighting LRU 10 may use control circuitry that ensures the LED is always operating within the published specifications of the manufacturer in order to maximize light output over its expected life. Wash lights 10 may also compensate for LED aging using a pre-defined table of values derived from the manufacturer specified change in output over time.

A lighting mode (scene) is defined as a specific configuration of cabin lighting LRUs so that their output creates the desired lighting. Scene development is the method of configuring cabin lighting LRUs to achieve that result on the airplane. This configuration data is typically stored as a loadable database or binary file containing configuration parameters such as color point, intensity, and scene transition times.

For most applications, the airplane lighting database may be developed off-site on a PC/Laptop and is uploaded to the airplane after configuration. The database format and method for loading the database can be defined according to a predefined standard. Tools may be used to generate lighting scene data to be loaded to the lighting LRUs 10. The following list details information that may be utilized to create a lighting database:

An aircraft configuration database

A PC/laptop computer

A lighting database creation application

The aircraft configuration database may be a graphical representation of all the lighting units on board the airplane. It can identify both the location and the associated logical address of each lighting LRU 10. This is required to correctly segment the lighting LRUs into zones which match the various sections of the cabin, allowing lighting zones to be changed without changing airplane wiring or lighting hardware.

A cabin management may be used to maintain the lighting database for the RGB cabin lighting system, with the lighting database downloaded to the CMS as required. Scene change messages can be initiated from the CMS using the stored lighting database, and are sent to the lighting LRUs to generate the selected scene.

Light intensity on the RGB cabin lighting system may be controlled by algorithms that ensure the best possible light quality and consistency. All scene information, which includes color point, intensity and transition time, may be stored in the lighting database resident in the CMS. When a scene is invoked, the CMS can transmit the scene information to the lighting LRU 10 over an RS-485 communication bus. Each lighting LRU 10 can use the scene information as inputs to their dimming algorithm to create smooth and controlled output as required.

Actual dimming may be performed using pulse width modulation. Wash light LRUs 10 used for general cabin use a linear constant current source to drive each string of LED's to ensure that there are no intrinsic LED current fluctuations. Duty cycle is a function of required light intensity level, calibration derived compensation values, temperature and accumulated running hours. When changing from one light level to another, a logarithmic intensity curve can be applied to provide a visually smooth transition. All functions that affect dimming levels such as temperature, aging and calibration will also follow the same logarithmic curve.

The log function is essentially a high resolution interpolation function that joins the start state and the end state within a scene transition. When dimming from an arbitrary intensity state to a different intensity state of the same color, the log function can maintain the same LED to LED intensity ratio throughout the transition. This in turn minimizes color shifts within the transition. The LED pulse width frequency should be greater than 250 Hz, eliminating flicker associated with led motion/vibration with respect to the observer. All LED's within a light strip can follow the same PWM clock source to prevent aliasing.

Scenes transition times, defined as the time required when changing from one scene to another, may be variable and are controlled through the CMS via the lighting database. Nonzero transition intervals cause the lighting LRU 10 to transition gradually until the desired state is reached within the specified time. In this case, the lighting LRU 10 transitions utilizing a higher time resolution (smaller time quantization) and follows a logarithmic path to avoid illumination flicker. The lighting LRUs 10 can transition between color points based on downloaded scene information. Scene related message transmissions may be repeated to reduce the probability of lost data. In such a case, the lighting LRU 10 may ignore repeated messages.

The lighting LRUs 10 may run internal power up tests, internal continuous monitoring and manually initiated tests in support of the diagnostic model of each LRU. The lighting LRUs can report all stored configuration information and unique identification data, such as device part number, serial number, software part numbers and database part numbers.

Power on tests for the lighting LRUs 10 can include, but may not be limited to, memory integrity checks, stored operational program and configuration data CRC verification and hardware watchdog restart events. Memory checks comprise RAM and flash memory read/write sequences to verify memory integrity. CRC checks can verify that specific data loaded from flash memory is correct. An integrated hardware watchdog timer can be utilized on all lighting LRUs to improve robustness.

Internal continuous testing may include temperature monitoring, low voltage conditions, bus errors or faults and addressing faults. Other fault or health data can be addressed as well. An LED lighting test can also be included as an initiated test. From the CMS, the operator can be able to select a predefined lighting state. This functionality can rely on the CMS limiting access to lighting test controls to maintenance mode only.

As part functional testing, protocol generators may be developed to enable testing of all communication to and from the lighting LRUs 10. Functionality may include loading of lighting databases and configuration databases as required. These protocol generators can be designed to test message formatting and sequence for accuracy and completeness. The protocol generators may be used during software development, hardware/software integration and software verification, and may be used during hardware qualification for system stimulation.

Table 3 through Table 6 below correspond to FIGS. 12A through 12D and illustrate exemplary configurations.

TABLE 3

| Full Color RGBW | | |
|---|---|---|
| Color Point | CIE 1931 x | CIE 1931 y |
| 1 | $0.611_{max}$ | 0.32 |
| 2 | 0.574 | 0.343 |
| 3 | 0.536 | 0.367 |
| 4 | 0.507 | 0.367 |
| 5 | 0.425 | 0.438 |
| 6 | 0.351 | 0.485 |
| 7 | 0.314 | 0.508 |
| 8 | 0.239 | $0.556_{max}$ |
| 9 | 0.226 | 0.466 |
| 10 | 0.212 | 0.376 |
| 11 | 0.198 | 0.286 |
| 12 | 0.185 | 0.197 |
| 13 | $0.171_{min}$ | $0.107_{min}$ |
| 14 | 0.215 | 0.128 |
| 15 | 0.259 | 0.149 |
| 16 | 0.303 | 0.171 |
| 17 | 0.347 | 0.192 |
| 18 | 0.435 | 0.235 |
| 19 | 0.523 | 0.277 |
| 20 | 0.3 | 0.419 |
| 21 | 0.286 | 0.329 |
| 22 | 0.273 | 0.239 |
| 23 | 0.361 | 0.282 |
| 24 | 0.405 | 0.303 |
| 25 | 0.493 | 0.346 |
| 26 | 0.205 | 0.202 |
| 27 | 0.215 | 0.201 |
| 28 | 0.173 | 0.123 |
| 29 | 0.47 | 0.39 |
| 30 | 0.43 | 0.383 |
| 31 | 0.344 | 0.345 |
| 32 | 0.378 | 0.366 |

TABLE 4

| White, Sunrise/Sunset, Night - RBW | | | |
|---|---|---|---|
| Color Point | Temp. (° K) | CIE 1931 x | CIE 1931 y |
| 1 | 6000 | 0.322 | 0.325 |
| 2 | 5500 | 0.331 | 0.337 |
| 3 | 5000 | 0.343 | 0.349 |
| 4 | 4500 | 0.361 | 0.364 |
| 5 | 4000 | 0.380 | 0.378 |
| 6 | 3500 | 0.401 | 0.390 |
| 7 | 3000 | 0.425 | $0.400_{max}$ |
| 8 | | 0.500 | 0.385 |
| 9 | | 0.529 | 0.345 |
| 10 | | $0.661_{max}$ | 0.322 |
| 11 | | 0.526 | 0.266 |
| 12 | | 0.452 | 0.274 |
| 13 | | 0.383 | 0.200 |
| 14 | | 0.253 | 0.140 |
| 15 | | $0.140_{min}$ | $0.084_{min}$ |
| 16 | | 0.245 | 0.216 |

TABLE 5

| White, Sunrise/Sunset - WWR or WWA | | | |
|---|---|---|---|
| Color Point | Temp. (° K) | CIE 1931 x | CIE 1931 y |
| 1 | 6000 | $0.319_{min}$ | 0.330 |
| 2 | 5500 | 0.331 | 0.337 |
| 3 | 5000 | 0.343 | 0.349 |

TABLE 5-continued

| White, Sunrise/Sunset - WWR or WWA | | | |
|---|---|---|---|
| Color Point | Temp. (° K) | CIE 1931 x | CIE 1931 y |
| 4 | 4500 | 0.361 | 0.364 |
| 5 | 4000 | 0.383 | 0.379 |
| 6 | 3500 | 0.409 | 0.394 |
| 7 | 3000 | 0.433 | $0.405_{max}$ |
| 8 | | 0.500 | 0.385 |
| 9 | | 0.529 | 0.345 |
| 10 | | $0.661_{max}$ | $0.322_{min}$ |
| 11 | | 0.449 | 0.367 |
| 12 | | 0.397 | 0.346 |

TABLE 6

| White Only - WWW | | | |
|---|---|---|---|
| Color Point | Temp. (° K) | CIE 1931 x | CIE 1931 y |
| 1 | 5000 | $0.345_{min}$ | $0.351_{min}$ |
| 2 | 4750 | 0.352 | 0.357 |
| 3 | 4500 | 0.361 | 0.364 |
| 4 | 4250 | 0.370 | 0.370 |
| 5 | 4000 | 0.380 | 0.377 |
| 6 | 3750 | 0.392 | 0.384 |
| 7 | 3500 | $0.405_{max}$ | $0.390_{max}$ |

Figure 12A:
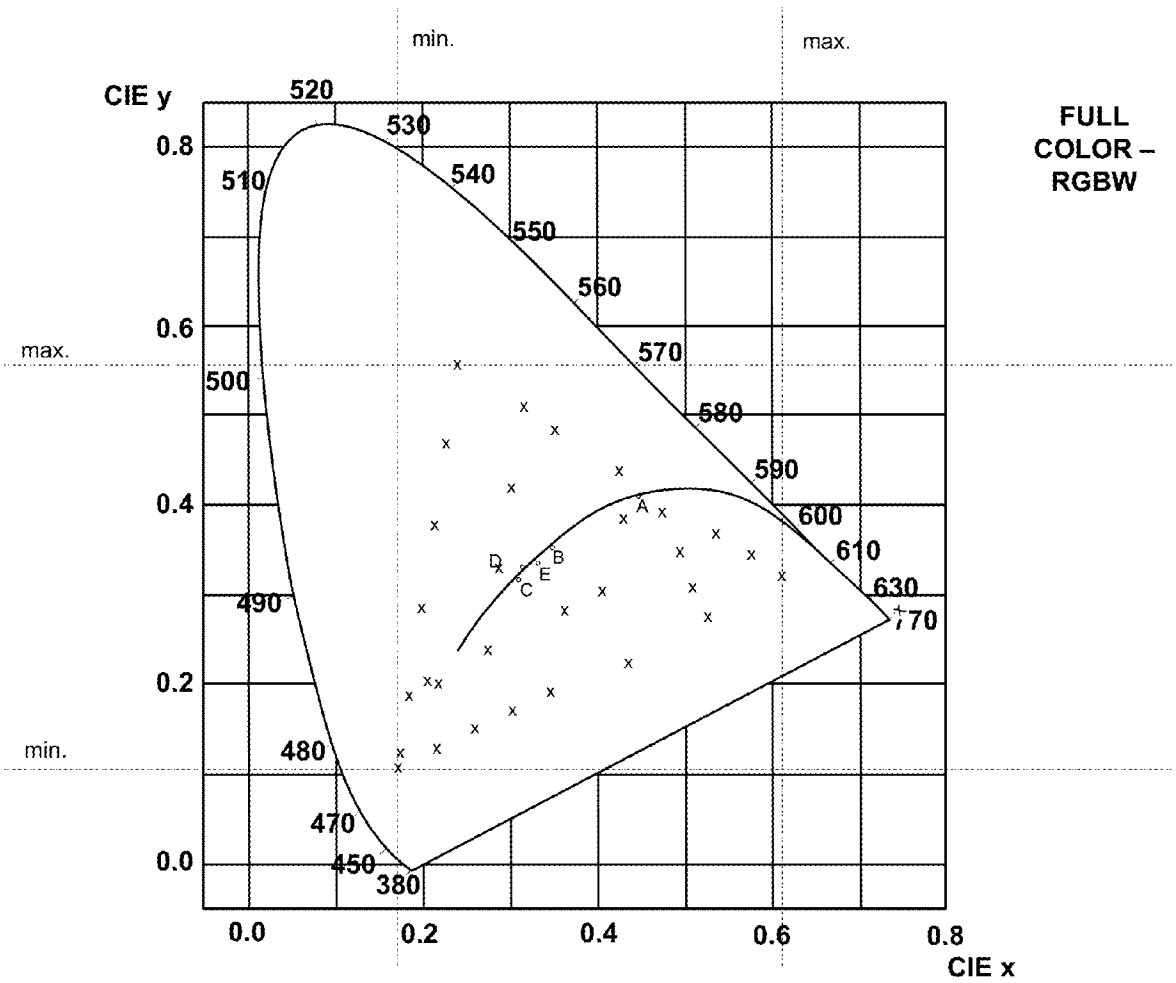
FIGS. 12A-D are CIE color charts illustrating a spread of color points for various types of LED modules.
Figure 12B:
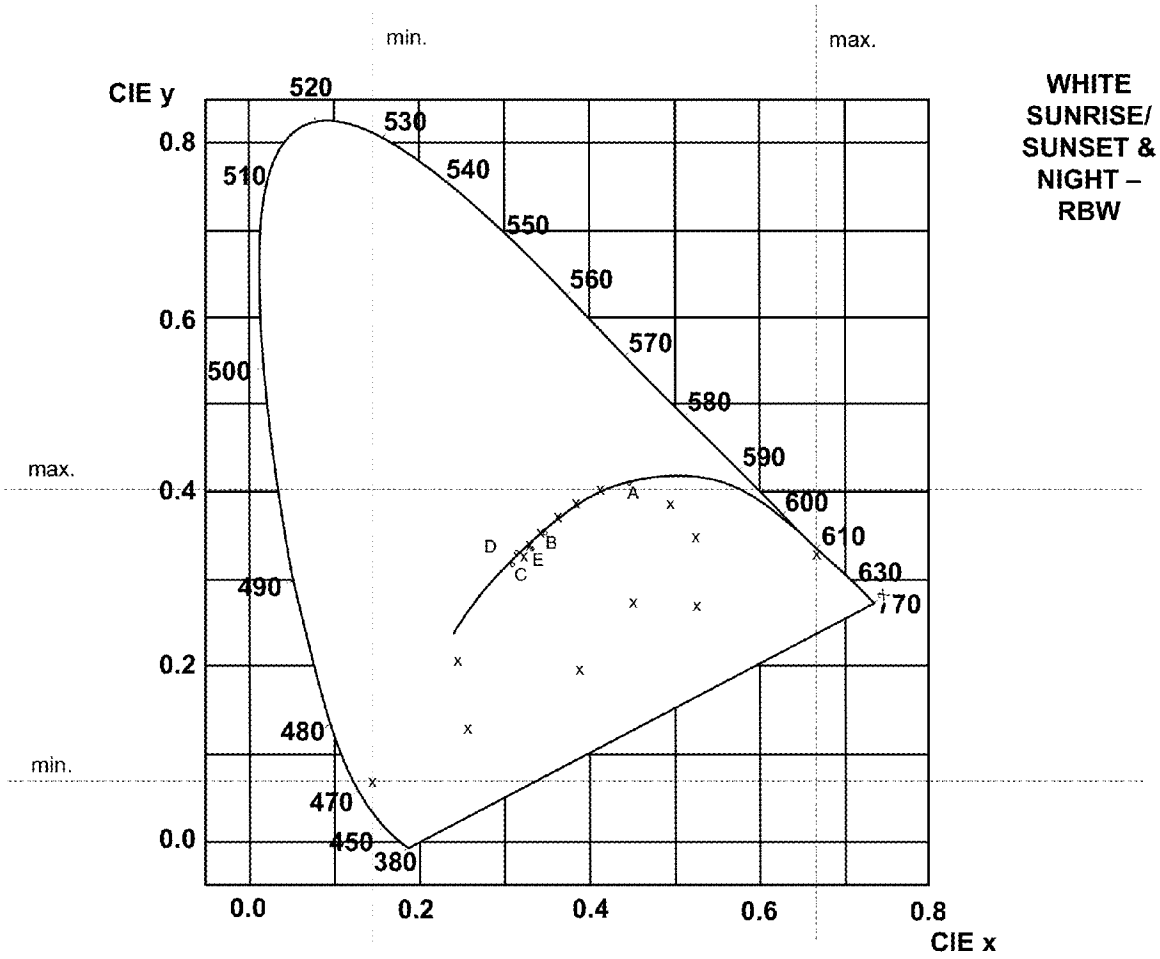

Table 3 and FIG. 12A illustrate various modules that can be provided, dependent on a customer's requirements. They illustrate an exemplary full-color module range in which a full color gamut can be provided. This may be achieved by the use of a red, green, blue, white (RGBW) combination of LEDs. As can be seen in Table 3 and FIG. 12A, this combination of LEDs can be used to create nearly any possible color in the gamut.

However, if the green LED is omitted (RBW), a relatively wide range of colors can still be provided that, e.g., in an aircraft cabin environment, replicates a sunrise, sunset, daylight, and night sky. This can be seen in Table 4 and FIG. 12B.

Figure 12C:
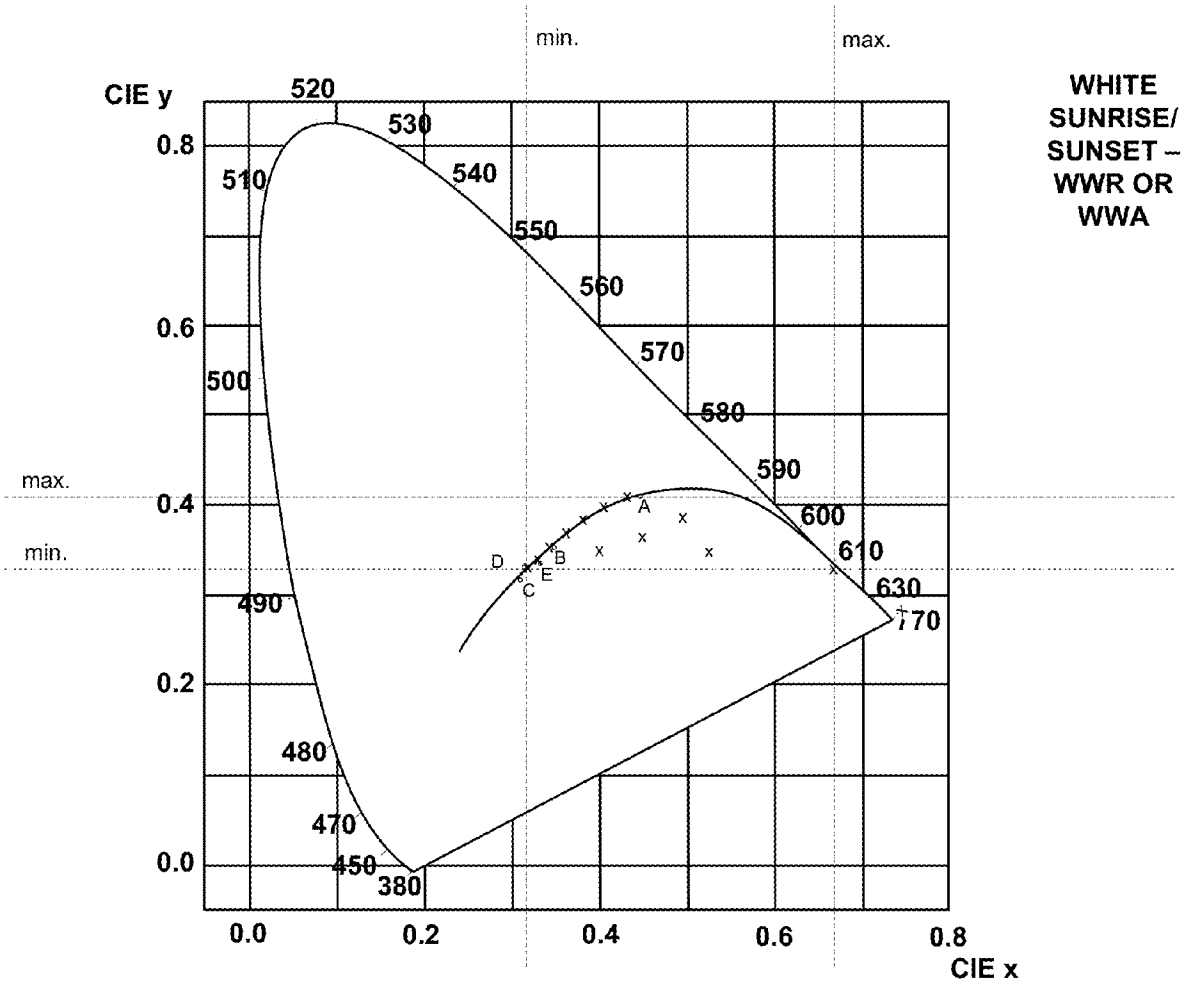
Figure 12D:
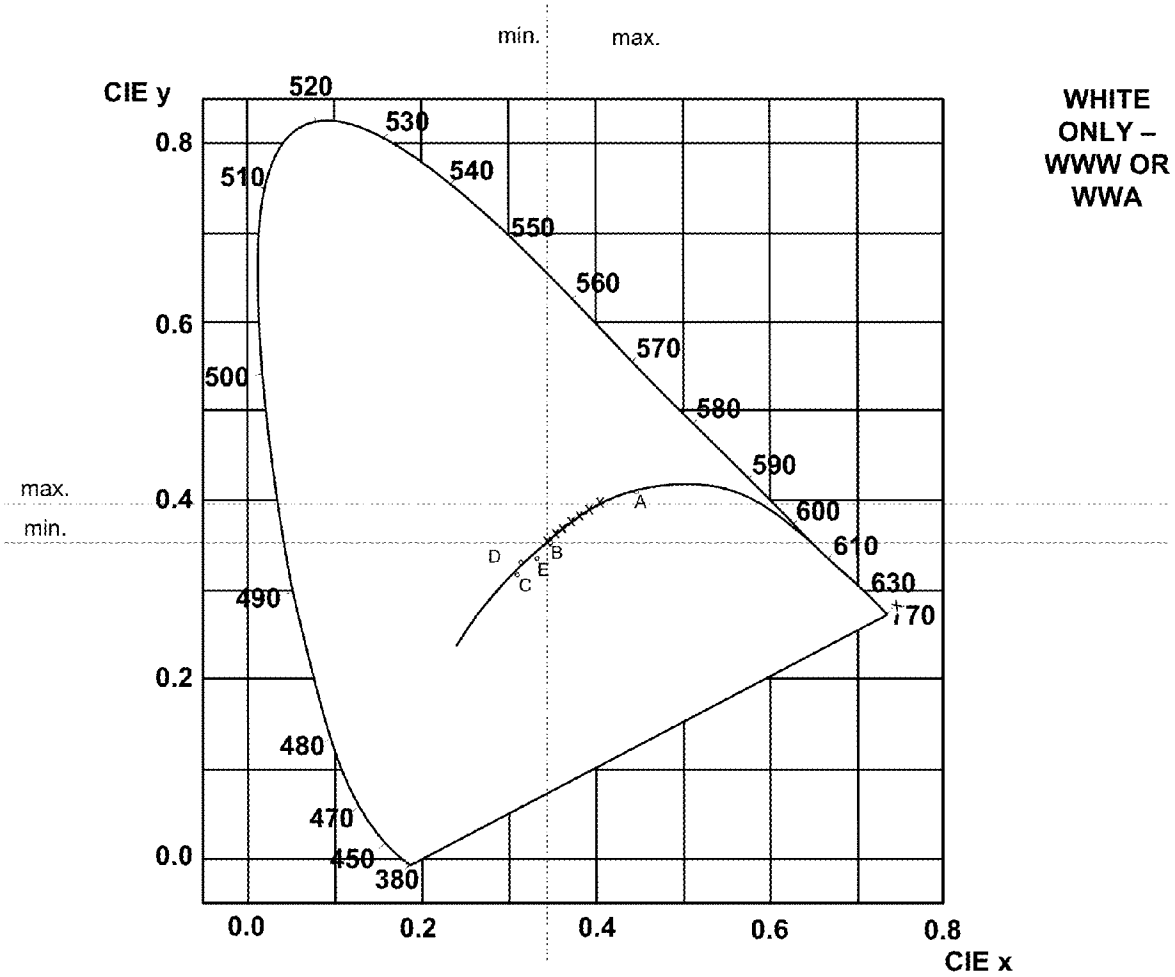

A further combination can be provided in which nighttime colors are omitted—such a design is illustrated in Table 5 and FIG. 12C, which utilize a WWR (white, white, red) or a WWA (white, white, amber) combination of LEDs. This configuration allows the creation of white, sunrise, and sunset colors.

A final combination can be provided utilizing only a WWW (white, white, white) or limited WWA combination, as illustrated in Table 6 and FIG. 11D. In this design, a focus on blackbody radiation temperature colors is utilized. In all of the above, a customer selectable wide color gamut pallet and algorithms can be used to ensure the purest and most saturated color pallet available.

FIGS. 12A-D illustrate where the colors for each or the module designs shown in Table 3 through Table 6 are located on the CIE 1931 chart. As can be seen, in the full-color design, the color points are spread out to cover a significant portion of the color chart, whereas the white only design has points located along the black body radiation locus.

Figure 13:
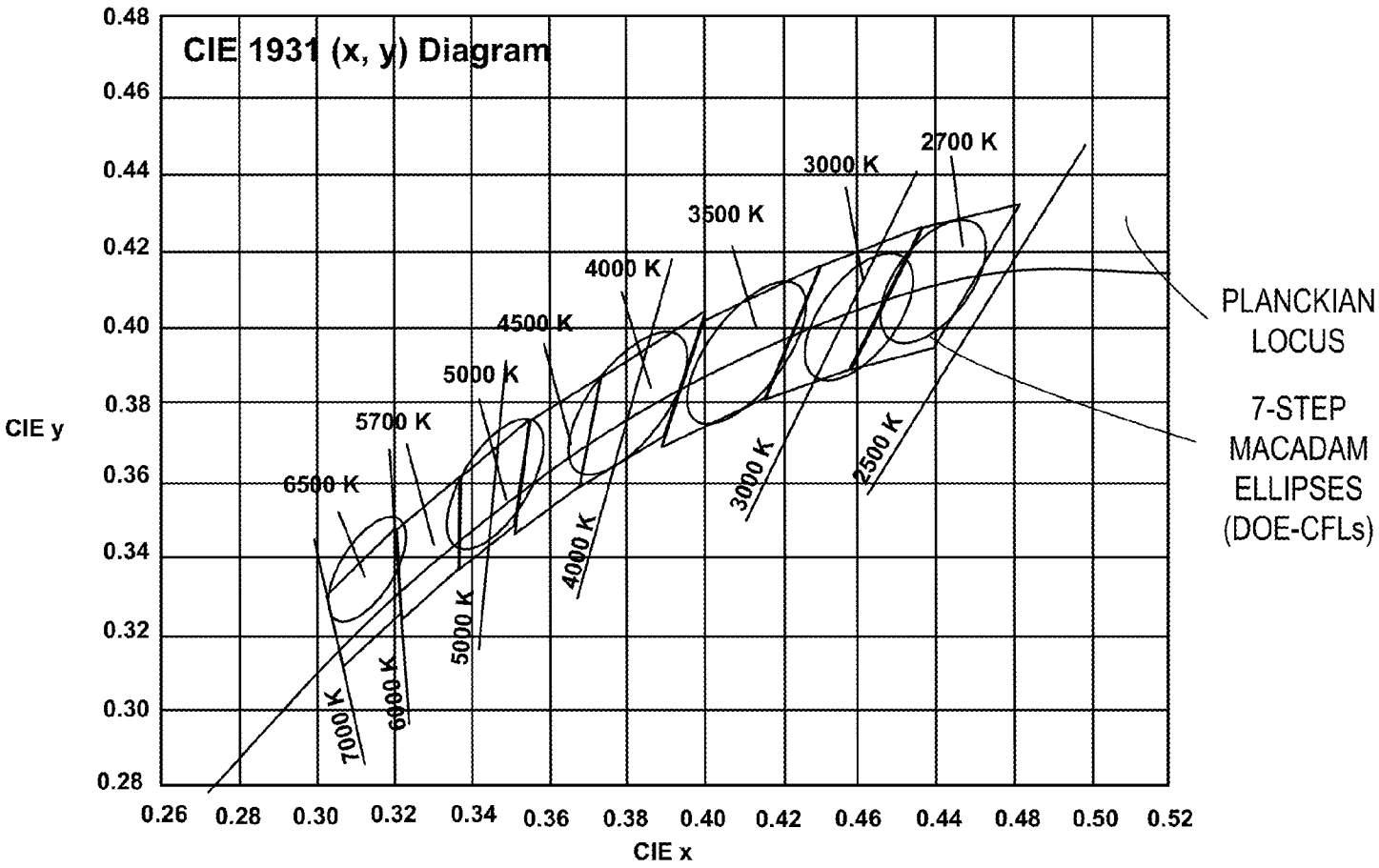
FIG. 13 is a zoom of a CIE color chart showing color variance along a Planckian locus.

FIG. 13 illustrates a magnified portion of the black body radiation curve and shows seven-step MacAdam ellipses associated with various color temperatures. Colors on a correlated color temperature (CCT) line can look very different across the board, but most people can only detect a color difference that corresponds with a greater than 250° K color temperature difference. One MacAdam Ellipse relative to an x, y-coordinate color point (CP) is generally what people see as a same color.

The chromaticity tolerances identified/specified in FIG. 13 are depicted as quadrangles rather than ellipses on the chromatic diagram. As noted above, these quadrangles correspond to approximately seven-step MacAdam ellipse on the CIE 1931 Chromaticity Diagram as shown in Table 7 below.

TABLE 7

| Nominal CCTTemp. (° K) | Target CCT and Tolerance (° K) | Target $D_{uv}$ and Toerance |
|---|---|---|
| 2700 | 2725 ± 145 | 0.000 ± 0.006 |
| 3000 | 3045 ± 175 | 0.000 ± 0.006 |
| 3500 | 3465 ± 245 | 0.000 ± 0.006 |
| 4000 | 3985 ± 275 | 0.001 ± 0.006 |
| 4500 | 4503 ± 243 | 0.001 ± 0.006 |
| 5000 | 5028 ± 283 | 0.002 ± 0.006 |
| 5700 | 5665 ± 355 | 0.002 ± 0.006 |
| 6500 | 6530 ± 510 | 0.003 ± 0.006 |
| Flexible CCT (2700-6500) | T ± ΔT | $D_{uv}$ ± 0.006 |

Although the SAE Aerospace Recommended Practice ARP5873 LED Passenger Reading Light Assembly, Issued 2007-03, Page 7, Paragraph 3.1.3 White Light Color Definition allows for approximately a seven-step MacAdam ellipse variance, it states that the majority of the population can discern a color difference.

Thus, the Lighting Research Center, Final Report: Developing Color Tolerance Criteria for White LEDs, dated Jan. 26, 2004, Page 2, Summary recommends use of a two-step MacAdam Ellipse binning of white LEDs for applications where the white LEDs are placed side-by-side and are directly visible.

Table 7 illustrates a nominal CCT color chart table. US DOE Energy Star recognizes CCTs of 2700° K, 3000° K, 3500° K, 4000° K, 4500° K, 5000° K, 5700° K, and 6500° K for indoor LED Luminaries for Residential and Commercial applications. The ANSI_NEMA_ANSLG C78.377-2008 Specification for the Chromaticity of Solid State Lighting (SSL) Products is a further source. For lighting products that provide white light, the color temperature range is typically specified from nominal CCT categories 2700° K to 6500° K.

It is preferable in an embodiment of the present design to maintain a color consistency within a light module 10 of a four-step MacAdam Ellipse, although tighter control can be maintained through a refined and accurate bin sorting, and premeasurement and matching of individual LED characteristics.

The system or systems described herein may be implemented on any form of computer or computers and the components may be implemented as dedicated applications or in client-server architectures, including a web-based architecture, and can include functional programs, codes, and code segments. Any of the computers may comprise a processor, a memory for storing program data and executing it, a permanent storage such as a disk drive, a communications port for handling communications with external devices, and user interface devices, including a display, keyboard, mouse, etc. When software modules are involved, these software modules may be stored as program instructions or computer readable codes executable on the processor on a computer-readable media such as read-only memory (ROM), random-access memory (RAM), CD-ROMs, magnetic tapes, floppy disks, and optical data storage devices. The computer readable recording medium can also be distributed over network coupled computer systems so that the computer readable code is stored and executed in a distributed fashion. This media is readable by the computer, stored in the memory, and executed by the processor.

All references, including publications, patent applications, and patents, cited herein are hereby incorporated by reference to the same extent as if each reference were individually and specifically indicated as incorporated by reference and were set forth in its entirety herein.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The embodiments herein may be described in terms of functional block components and various processing steps. Such functional blocks may be realized by any number of hardware and/or software components that perform the specified functions. For example, the described embodiments may employ various integrated circuit components, e.g., memory elements, processing elements, logic elements, look-up tables, and the like, which may carry out a variety of functions under the control of one or more microprocessors or other control devices. Similarly, where the elements of the described embodiments are implemented using software programming or software elements the invention may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the embodiments of the invention could employ any number of conventional techniques for electronics configuration, signal processing and/or control, data processing and the like. The words "mechanism" and "element" are used broadly and are not limited to mechanical or physical embodiments, but can include software routines in conjunction with processors, etc.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical".

The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Expressions such as "at least one of," when preceding a list of elements, modify the entire list of elements and do not modify the individual elements of the list.

The use of the terms "a" and "an" and "the" and similar referents in the context of describing the invention (especially in the context of the following claims) should be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein are performable in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those skilled in this art without departing from the spirit and scope of the invention.

TABLE OF REFERENCE CHARACTERS

| | |
|---|---|
| 10 | wash light module; component module; LED module |
| 12 | module housing |
| 14 | printed circuit board (PCB) |
| 15 | jumper portion |
| 16 | thermal pad; heat sink |
| 18 | snap clip |
| 20 | power supply |
| 30 | integrated LED and digital controller (ILDC) |
| 32 | module controller |
| 35 | filter |
| 37 | DC/DC converter |
| 40 | light emitting diode (LED) |
| 42 | CPU/memory |
| 44 | I/O |
| 46 | LED driver |
| 48 | self-test control |
| 49 | operational program |
| 50 | lens |
| 60 | cabin management system (CMS) |

What is claimed is:

1. A light-emitting diode (LED) light module, comprising:

a separate first and second single-piece printed circuit board (PCB), each comprising the following integrated on the PCB:

a plurality of LEDs in each of a plurality of LED groups;

a power supply converter that supplies power to drive the plurality of LEDs; and a controller module comprising a processor, memory, operational program stored in the memory and executable by the processor; input/output (I/O) circuitry, and an LED driver that drives the LEDs;

the LED light module further comprising:

a single metallic housing that contains both the first and second PCBs;

a heat sink that conducts heat from components on the first and second PCBs to the housing; and a lens for diffusing or directing lights from the LEDs.

2. The LED light module of claim 1, wherein:

the LED light module cross-section dimensions, including a mounting clip having a portion with a contour that matches that of the LED light module to hold the LED light module in position relative to the clip, are selected from the group consisting of: 0.59 "×0.56", 0.55 "×0.71", and 0.82 "×0.68"; and the LED light module length dimensions are selected from the group consisting of: m ×n", where n =4" and m is a set of integer values from 2 to 24.

3. The LED light module of claim 1, wherein the LED light module:

weighs ≤3.9 oz. / ft.; and consumes ≤6 watts / ft.

4. The LED light module of claim 1, wherein the power supply converter is operable over a range of 18 VDC to 30.3 VDC.

5. The LED light module of claim 1, further comprising a power filter integrated on each of the first and second PCBs.

6. The LED light module of claim 1, further comprising a temperature sensor and a thermal management system integrated on each of the first and second PCBs.

7. The LED light module of claim 1, further comprising, within the memory, calibrated temperature corrected and age-calibrated color values or compensations values that are used to drive the LEDs.

8. The LED light module of claim 1, further comprising a self-test module.

9. The LED light module of claim 8, wherein the self-test module comprises an algorithm that corrects the output drive based on temperature and safely shuts down the LED light module if an overheat condition is detected.

10. The LED light module of claim 1, further comprising a microlens mounted over the LED that directs light from the LEDs exclusively in a single direction.

11. The LED light module of claim 1, wherein:

each group has LEDs of at least two different colors;

all of the LED groups in the LED light module have a common LED grouping selected from the group consisting of: RBW, WWR, WWA, and WWW, wherein the WWW grouping utilizes white LEDs of different white shades.

12. The LED light module of claim 11, wherein all color points stored in color point tables lie within the following CIE chart (x, y) rectangle corner boundaries:

for the RBW group: (0.140, 0.084), (0.661, 0.400);

for the WWR or WWA group: (0.319, 0.322), (0.661, 0.405); and for the WWW group: (0.345, 0.351), (0.405, 0.390).

13. The LED light module of claim 1, further comprising:

jumper boards that interconnect all PCBs in the LED light module.

14. The LED light module of claim 1, wherein colors of all LEDs are maintained within a four-step MacAdam ellipse of each other.

* * * * *